US006457267B1

(12) United States Patent
Porter et al.

(10) Patent No.: US 6,457,267 B1
(45) Date of Patent: Oct. 1, 2002

(54) TRENCHING AND EDGING SYSTEM

(76) Inventors: Roger D. Porter, 7882 E. Highway 19, Loris, SC (US) 29569; Jerome C. Burroughs, P.O. Box 776, Loris, SC (US) 29569

( * ) Notice: Subject to any disclaimer, the term of this patent is extended or adjusted under 35 U.S.C. 154(b) by 0 days.

(21) Appl. No.: 09/587,631

(22) Filed: Jun. 5, 2000

Related U.S. Application Data

(63) Continuation-in-part of application No. 29/117,980, filed on Feb. 2, 2000.

(51) Int. Cl.[7] ..... E02F 5/08
(52) U.S. Cl. ..... 37/142.5
(58) Field of Search ..... 37/94, 142.5, DIG. 8; 172/41, 42, 43; 405/174, 179, 180, 181

(56) References Cited

U.S. PATENT DOCUMENTS

| | | | | |
|---|---|---|---|---|
| 917,821 | A | 3/1909 | White | |
| 2,903,077 | A | 9/1959 | Kamlukin | 172/42 |
| 2,928,479 | A | 3/1960 | Petersen | 172/16 |
| 2,997,276 | A | 8/1961 | Davis | 254/166 |
| 3,132,539 | A | 5/1964 | Hotz | 74/792 |
| 3,442,335 | A | 5/1969 | Silbereis et al. | 172/43 |
| 3,496,973 | A | 2/1970 | Ballard | 143/133 |
| 4,002,205 | A | 1/1977 | Falk | 172/15 |
| 4,043,399 | A | 8/1977 | Morrison | 172/42 |
| 4,094,362 | A | 6/1978 | Hild | 172/120 |
| 4,188,934 | A | 2/1980 | Reinhardt et al. | 125/4 |
| 4,346,764 | A | 8/1982 | Rossi | 172/42 |
| 4,421,178 | A | 12/1983 | Vandelli et al. | 172/548 |
| 4,503,630 | A | 3/1985 | Riley | 37/94 |
| 4,545,438 | A | 10/1985 | Giovanni | 172/123 |
| 4,625,810 | A | 12/1986 | Edmission | 172/749 |
| 4,825,569 | A | 5/1989 | Porter | 37/142.5 |
| 4,914,840 | A | 4/1990 | Porter | 37/142.5 |
| 4,939,854 | A | 7/1990 | Boren | 37/94 |
| 4,958,457 | A | 9/1990 | Doskocil | 37/94 |
| 4,979,573 | A | 12/1990 | Williamson | 172/15 |
| 5,009,270 | A | 4/1991 | Vangsgard | 172/42 |
| 5,226,248 | A | 7/1993 | Pollard | 37/94 |
| 5,228,221 | A | 7/1993 | Hillard et al. | 37/355 |
| 5,320,451 | A | 6/1994 | Garvey et al. | 405/181 |
| 5,355,597 | A | 10/1994 | Pollard | 37/94 |

FOREIGN PATENT DOCUMENTS

| | | | |
|---|---|---|---|
| SU | 1082908 | A | 3/1984 |

*Primary Examiner*—Robert E. Pezzuto
(74) *Attorney, Agent, or Firm*—Leatherwood Walker Todd & Mann, P.C.

(57) ABSTRACT

A combination machine for trenching, for forming the edge of a bed, and for laying and burying tubing, cable, piping, and the like. The machine includes steerable caster wheels mounted on the rear of the machine which, together with a single front wheel, allow for a tight turning radius when using the machine. The machine also includes a blade height adjustment which allows for the trenching or edging blade depth to be readily adjusted in a substantially infinite variation. An edging blade is provided which when used with the machine forms a groove at the bed's edge for the laying of irrigation lines, or lines for herbicide, pesticide, and/or fertilizer for use in connection with the bed.

20 Claims, 15 Drawing Sheets

W
22
20
44
24
48
52
18
H
10
42
32
28
M
34
B
40
26
F
T
38
12
14

TRENCHING AND EDGING SYSTEM

This is a continuation-in-part of application Ser. No. 29/117,980, filed Feb. 2, 2000, now pending.

BACKGROUND OF THE INVENTION

This invention relates generally to a trenching and edging device for digging trenches and for edging the soil for beds for flowers, shrubbery, mulch, etc.

Small trenching machines find application in those circumstances where it is necessary to dig a relatively narrow trench. This could be the case where cable TV is being buried to provide service to a residence or business, or could be when it is necessary to run a gas line, waterline, or other utility to a home or office. Further uses of such a trench could be for running irrigation line or what is known as radio or "invisible" fencing used to keep pets within a confined area, the pet then wearing a cooperating collar which is activated to shock the animal in the event the animal comes too close to the buried line.

Edging machines find use with landscapers and homeowners for defining a bed used for ornamental plantings, shrubbery, flowers, mulch, or the like and serve to form the defined edge of a bed to be created by cutting the soil to a depth, typically several inches, and then lifting the soil and moving it outwardly to form a mounded periphery for the bed. Generally, it is desirable that the turf adjacent the bed have a distinct, clean break between it and the bed. This provides for a clean definition of the bed which is desired for aesthetic and maintenance purposes.

Trenching machines and edging machines are known. For example, U.S. Pat. No. 4,939,854, issued to Boren, discloses a trencher having a digging depth adjustment configuration including a rotatable handle in order to accomplish such depth adjustment. U.S. Pat. No. 4,002,205, issued to Falk, and U.S. Pat. No. 5,226,248, issued to Pollard, both disclose bed edge forming machines for forming the edge of a bed.

U.S. Pat. No. 5,320,451, issued to Garvey, et al, discloses a tiller having a cable-laying attachment and also a provision for carrying a spool of cable, and a feed tube through which the cable is inserted into a trench. U.S. Pat. No. 5,009,270, issued to Vangsgard, discloses a sod-cutting machine having an adjustable depth adjustment, and U.S. Pat. Nos. 4,958,457, issued to Doskocil, and 4,979,573, issued to Williamson, both disclose devices using caster wheels for steering. The Doskocil device includes rear-mounted casters.

In view of the foregoing known devices, there still exists a need for a combination trenching and edging device which is designed to facilitate movement and steering of the device and which also can be used to dig at varying depths.

SUMMARY OF THE INVENTION

It is, therefore, the principal object of this invention to provide a combination trenching and edging system.

Another object of this invention is to provide an edging machine having readily variable digging depth adjustment capability.

Another object of this invention to provide a combination trenching and edging system having improved steerability during use.

Yet another object of the present invention is to provide an improved edging blade design.

Still another object of the present invention is to provide a edging blade which, during use, defines a groove in the soil for receiving conduit, tubing, wire, or the like.

Another object of the present invention is to provide an edging blade having self-sharpening cutting edges.

A further object of the present invention is to provide an edging blade which forces soil outwardly from the blade during use.

A still further object of the present invention is to provide a trenching machine and a method for digging a trench, laying conduit wire, cable or the like in the trench, and backfilling the trench after laying the wire or cable, all in a single pass.

Generally, the present invention includes a trenching and edging system which is portable, and operable by a single user. The present invention includes a soil bed edge-forming machine, having a frame and a motor and wheels connected to the frame. A digging blade is drivingly connected to the motor, and a digging depth adjustment member is connected to the digging blade, with the adjustment member being rotatable for allowing selective digging depth adjustment of the digging blade into the soil.

More specifically, the trenching and edging machine of the present invention includes steerable casters mounted on the rear of the machine which, together with a single front wheel, allow for a tight turning radius when using the machine, thereby facilitating maneuverability of the machine. The machine also includes a blade height adjustment which allows the trenching blade or edging blade height, and, accordingly, the digging depth, to be readily adjusted in substantially infinite variation between the raised and lowermost position. The machine is further capable of digging a trench, laying wire, cable, tubing, etc., and backfilling the trench in a single pass.

Another feature of the machine is a edging blade which includes spring steel digging fingers having carbide tips. As the edging blade is used, it forms a generally-perpendicular wall adjacent the edge of the bed and mounds the dirt towards the bed in an outwardly angled, tapered fashion, opposite the generally-perpendicular wall. At the base of the wall, adjacent the mounded dirt, a groove is formed which is generally below the elevation of the mounded dirt. This groove can be used for the laying of cable, herbicide, pesticide, and/or fertilizer lines, irrigation lines, radio or invisible fencing for pets, etc.

Moreover, the present machine includes a blade guard system which covers the trencher blade regardless of the digging depth of the trencher blade and which also covers the blade when the blade is in the fully raised state, such as would be the case when the machine is being transported.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
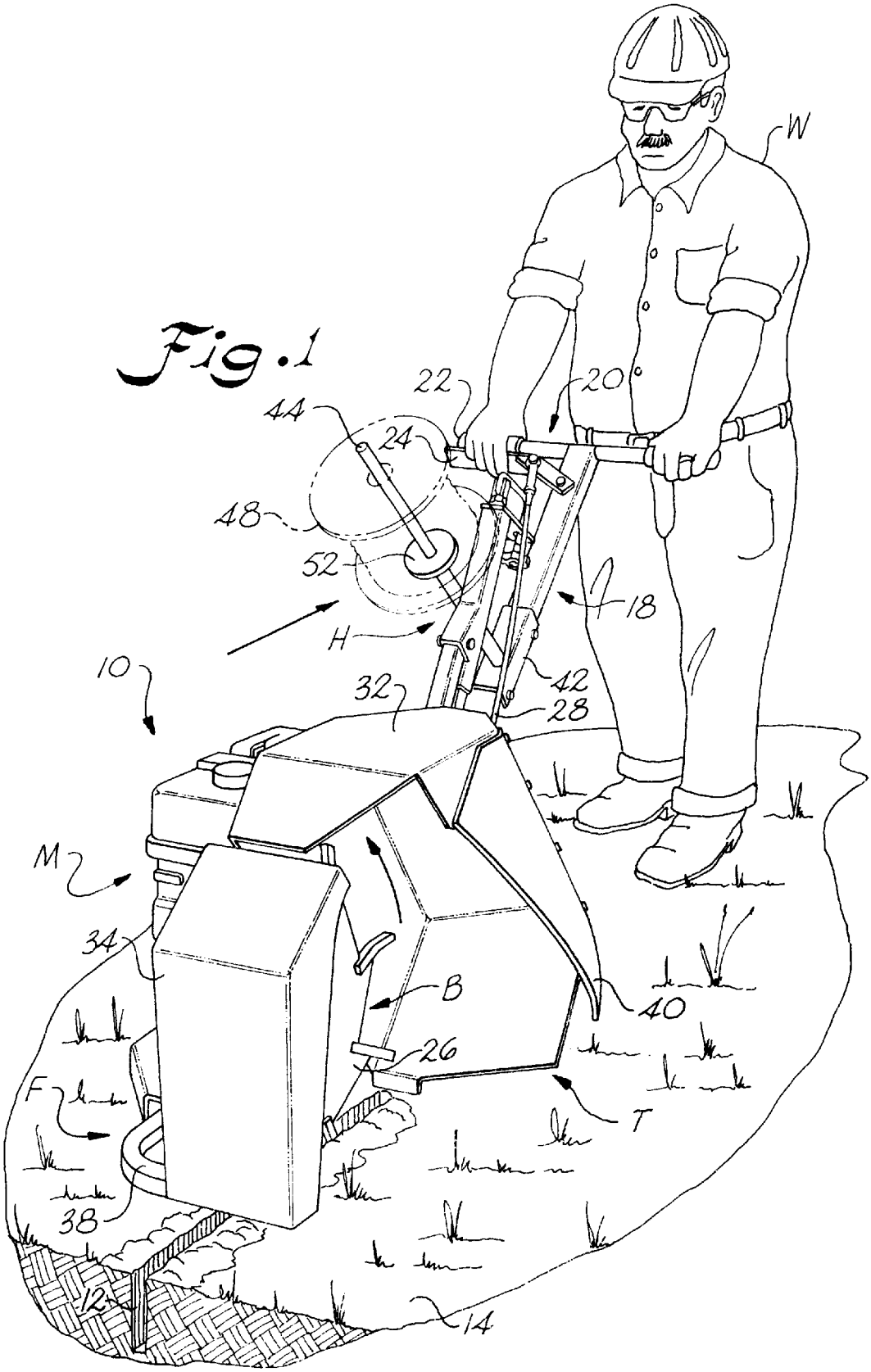
FIG. 1 is a perspective view of a trenching and edging system constructed in accordance with the present invention, illustrating the trenching and edging machine in use digging a trench.

The accompanying drawings and the description which follows set forth this invention in its preferred embodiment. However, it is contemplated that persons generally familiar with earth working equipment will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the trenching and edging system of the present invention is indicated generally in the figures by reference character 10.

Turning to FIG. 1, the trenching and edging system 10 is shown in use as a trencher T. The user, or worker W is pulling the machine 10 rearwardly in order to form a trench 12 in the ground 14. Machine 10 includes a frame, generally F, and a motor, generally M, connected to the frame F. Extending upwardly from frame F is a handle support arm 18, to which a handle 20 is attached. Grips 22 are provided on the handle for grasping by worker W.

A drive lever 24 is pivotally connected to handle support 18, the drive lever being pulled towards handle 20 by worker W when it is desired to engage the digging blade, generally B, which in FIG. 1 is shown as being a trenching blade 26. The pulling of drive lever 24 by worker w causes a corresponding pulling of cable 28 which in turn engages a drive transmission, generally 30, more clearly shown in FIGS. 2 and 5.

Also shown on FIG. 1 is a blade height/depth adjustment assembly, generally H, which will be discussed in more detail below.

Machine 10 includes shroud 32 and guard 34, which are connected to frame F. Shroud 32 and guard 34 serve to cover trenching blade 26 during operation and during transport, primarily for safety purposes. Note that guard 24 is connected to frame F via a support bar 38. A flexible guard 40 is attached to shroud 32 for deflecting rocks, dirt, or other underground buried objects which may be unearthed and thrown upwardly by trenching blade 26 during use. Flexible guard 40 could be constructed of rubber, plastic, or some other resilient material.

Attached to handle support 18 is a bracket 42 which supports a spool axle 44 for carrying a spool 48 of wire, conduit, cable, drip line, tubing, or the like when machine 10 is used for laying and burying same. The spool axle 44 includes a flange 52 on which spool 48 rests during use. Operation of machine 10 for burying such wire, cable, tubing, etc. will be discussed further below.

Figure 2:
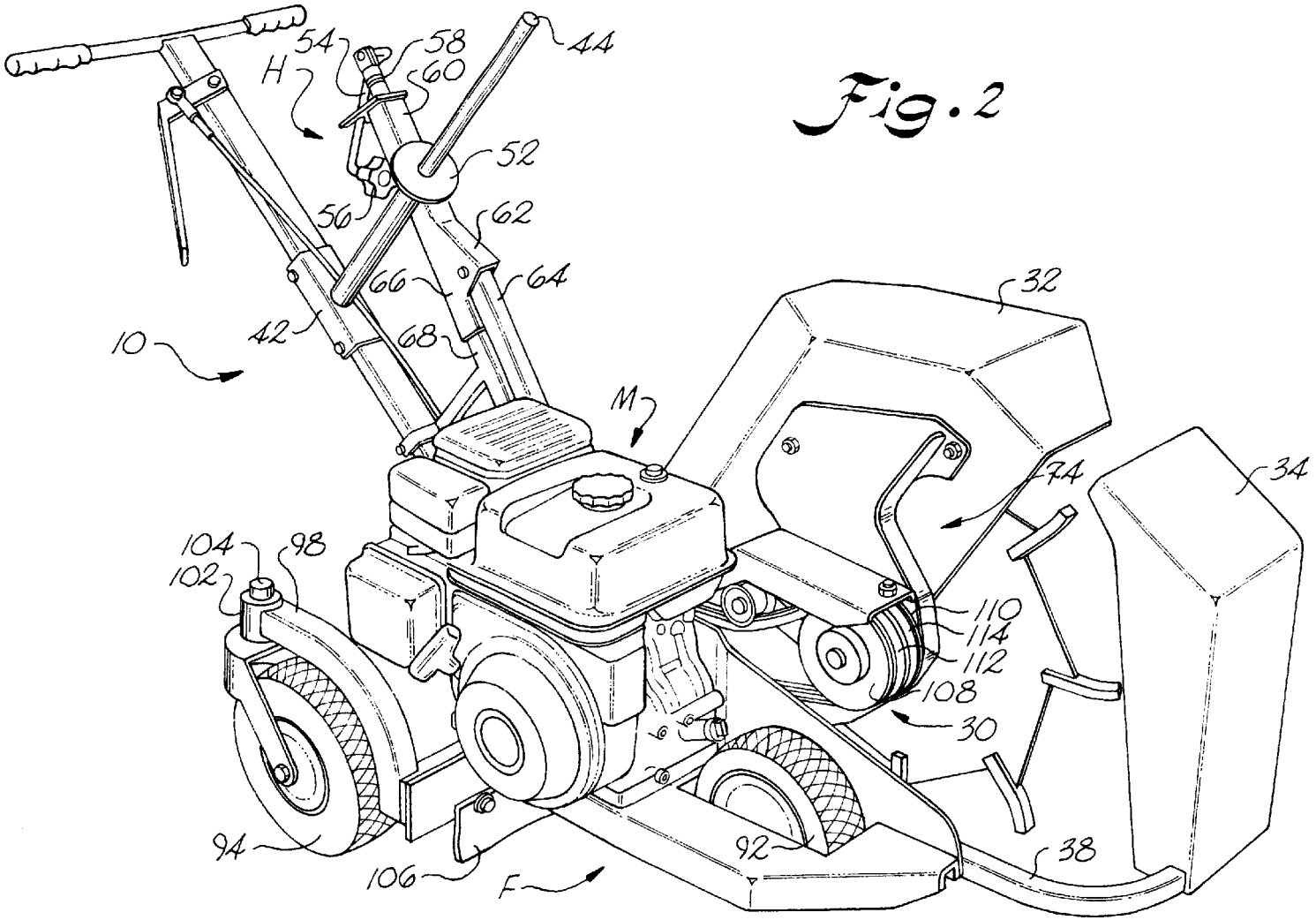
FIG. 2 is a perspective view of the trenching and edging machine of the present invention.

FIG. 2 illustrates the left side of machine 10 and the blade height adjustment configuration H in more detail. The mechanism H includes a crank arm 54 having a knob 56 rotatably connected to a threaded shaft or rod 58. The shaft 58 extends through a tower 60 which includes a first collar 62 for receiving a pivotal link 64 and a second collar 66 for receiving a stationary link 68. Collar 66 is configured for sliding movement relative to stationary link 68 when crank arm 54 is turned by knob 56 by the user.

Figure 7:
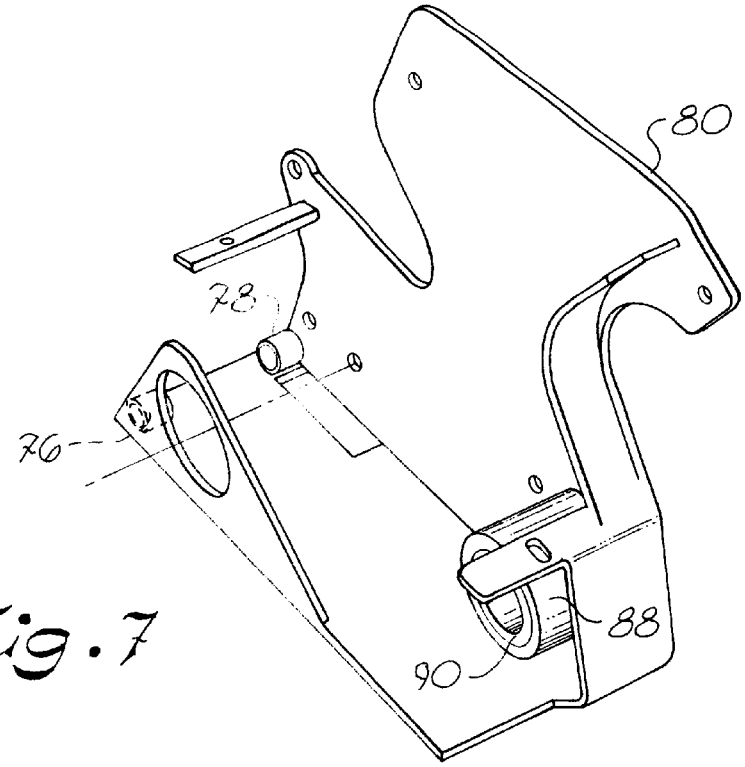
FIG. 7 is a perspective view of a bracket for the trenching and edging machine for carrying a blade for the machine.
Figure 8:
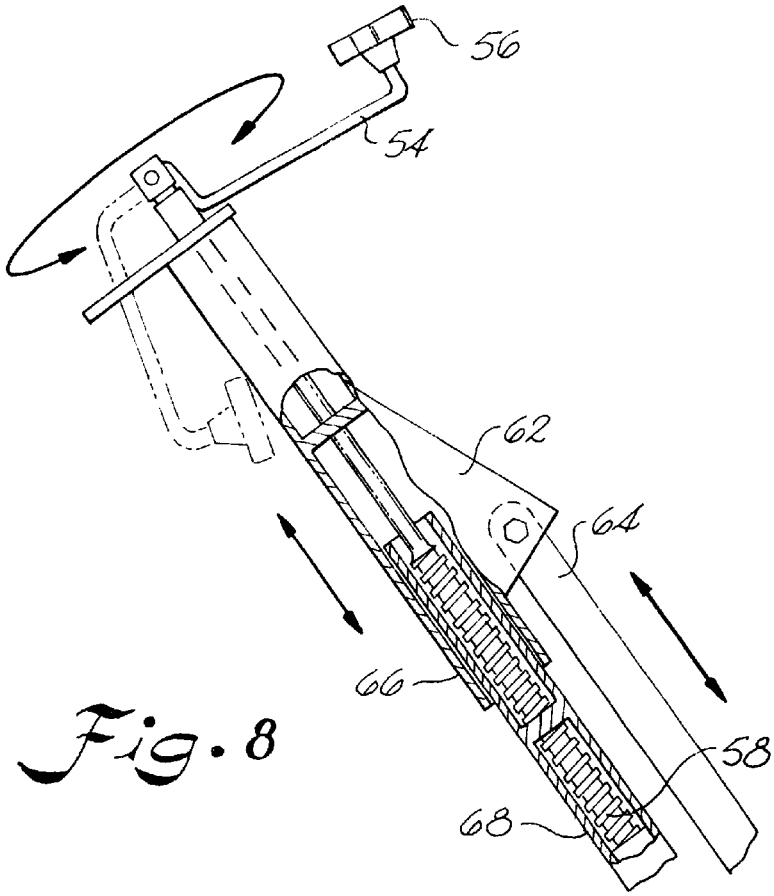
FIG. 8 is a partial perspective view, with parts cut away, of the blade height adjustment configuration of the trenching and edging machine.

As shown in more detail in FIGS. 6 through 9B, as crank arm 54 is turned, collar 66 moves upwardly or downwardly, depending on the direction of rotation of crank arm 54 with respect to stationary link 68. This causes the upper end of pivotal link 64 to pivot with respect to collar 62 and the lower end 70 of pivotal link 64 to pull upon or push on a shaft 72. Shaft 72 is connected to a bracket arrangement, generally 74, which carries the transmission, or blade drive mechanism, 30 having digging blade B. Shaft 72 is carried in bosses 76, 78 which are fixedly connected to a bracket 80. Bracket 80 includes an opening 82 for receipt of the drive shaft 84 of motor M, such opening also extending through a corresponding bracket 86 fixedly attached to frame F. Accordingly, rotation of crank arm 54 as shown in FIG. 8, advances threaded rod 58 upwardly or downwardly, which in turn causes pivotal link to pivot bracket arrangement 74, thereby raising or lowering the digging blade B.

FIG. 7 illustrates bracket 80 in further detail, and bracket 80 includes boss 88 which carries a bushing 90 for drive shaft 84 (FIG. 5) for driving the digging blade.

Figure 9A:
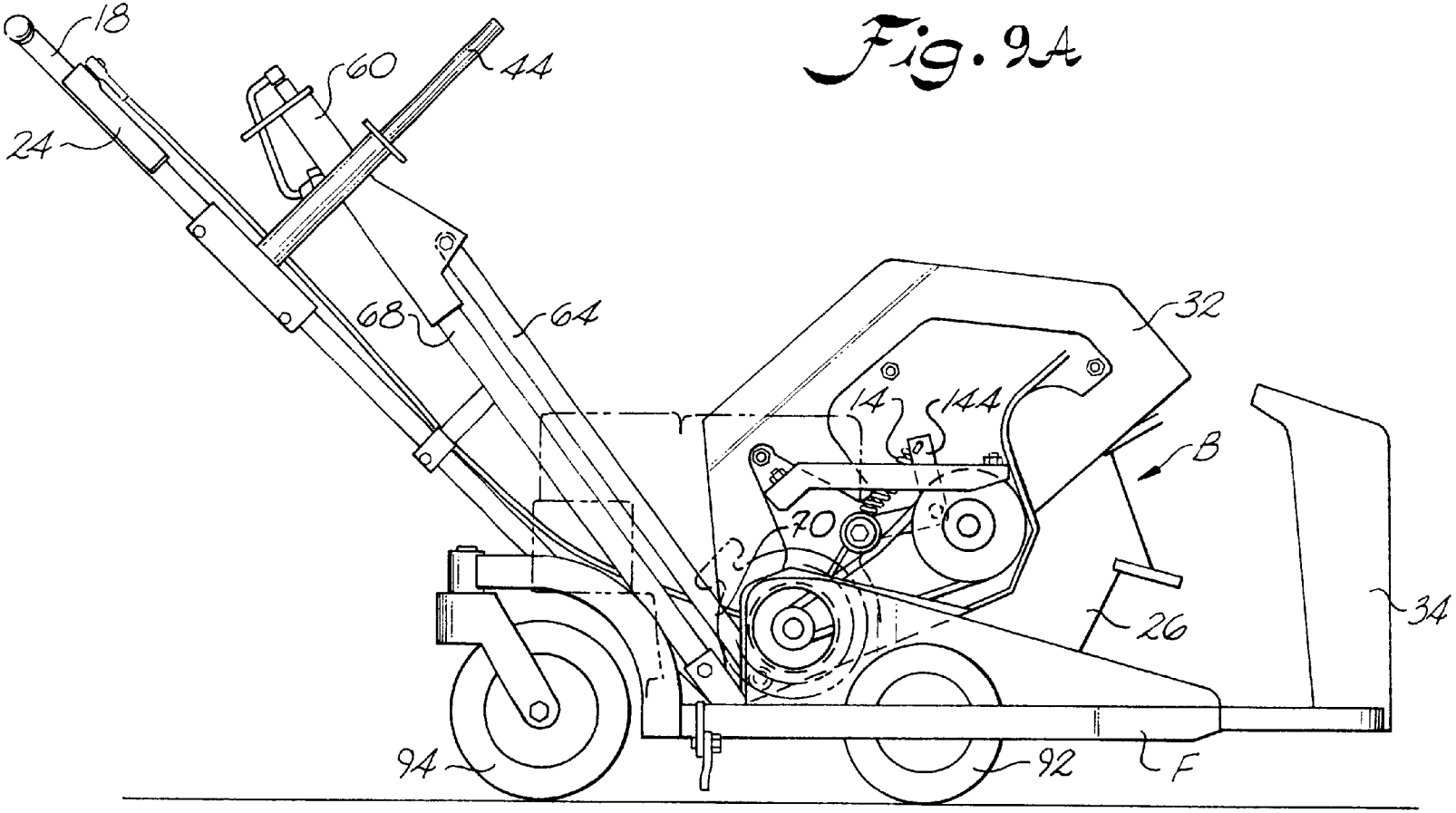
FIG. 9A is a partial side elevational view illustrating blade height adjustment configuration of the trenching and edging machine, illustrating a trenching blade in a raised position.
Figure 9B:
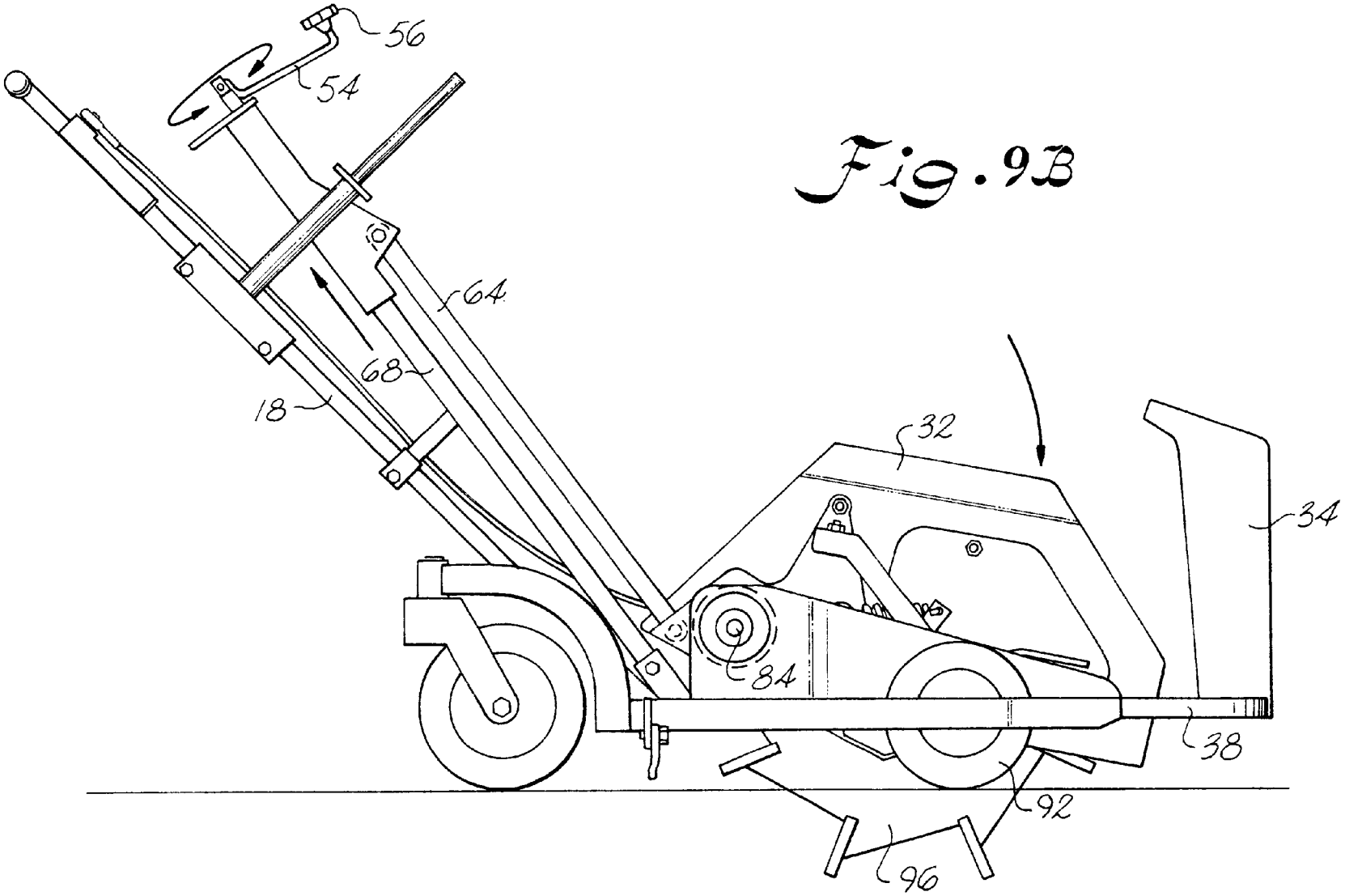
FIG. 9B is a partial side elevational view of the trenching and edging machine, illustrating the trenching blade in a lowered position.

FIG. 9A shows the digging blade B raised to its uppermost position. Note the position of pivotal link 64 and the upward incline of shroud 32. FIG. 9B illustrates the blade in the lowered digging position, and note the relative position for the lower portion 70 of pivotal link 64 with respect to the bracket 80 which attaches stationary link 68 to frame F.

Figure 3:
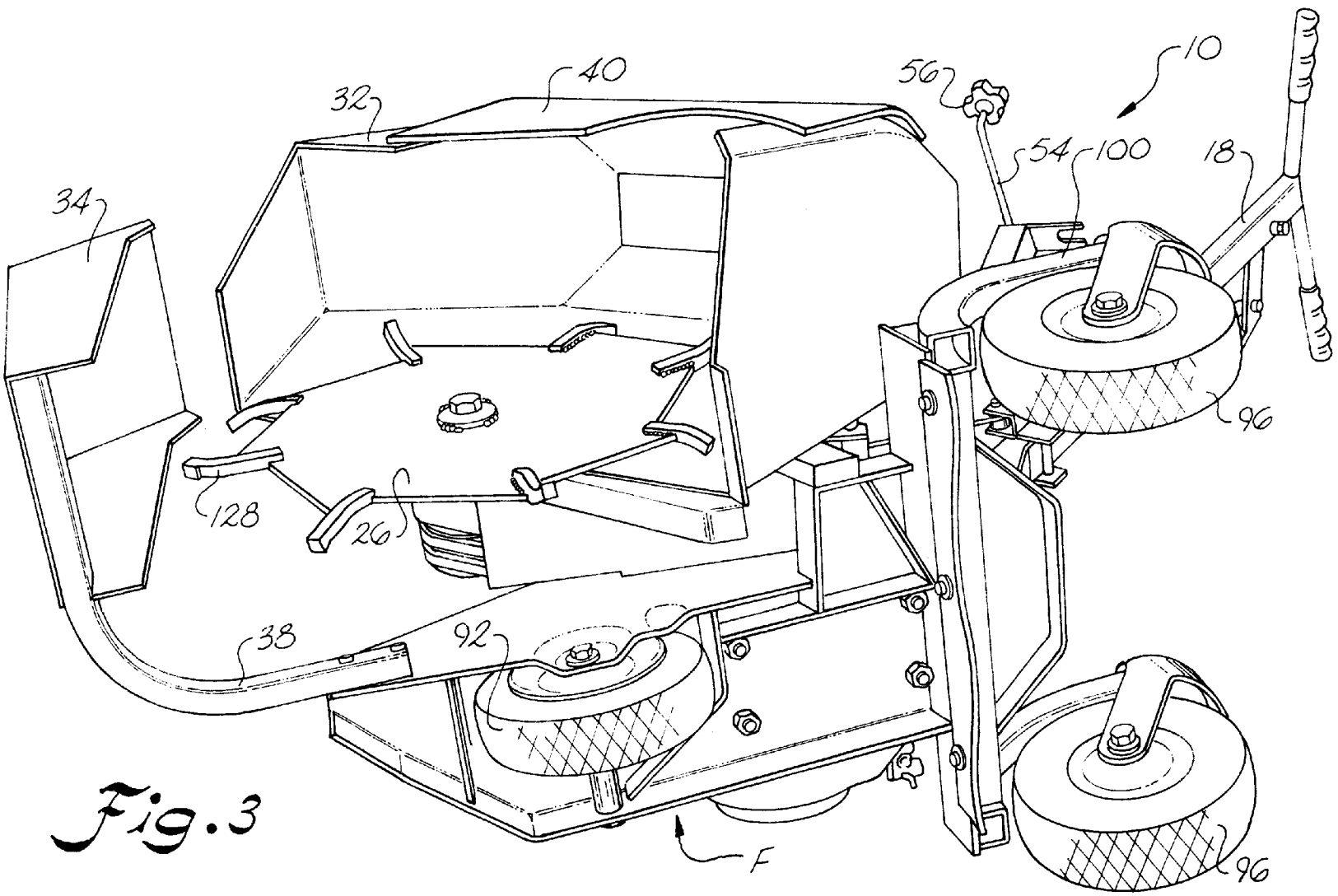
FIG. 3 is a bottom perspective view of the trenching and edging machine constructed in accordance with the present invention.

Returning to FIG. 2, machine 10 includes a single front wheel 92 and two rear wheels 94, 96 (FIG. 3). Rear wheels 94, 96 are caster wheels and freely pivot with respect to frame F. Curved support arms 98, 100, connect the rear wheels to the frame F, and support arms 98, 100, and include bosses 102 through which pivot axles 104 of wheels 94, 96 extend.

A downwardly extending flexible guard 106 is provided on the underside of frame F to further catch and minimize throw-back of objects onto worker W during use. Bracket arrangement 74, discussed above, can be seen from another perspective in FIG. 2, and serves to shroud driven pulleys 108, 110, which connect via two drive belts 112, 114, to two drive pulleys 116, 118 (FIG. 5) connected to the output shaft 84 of motor M. It is noted here that motor M is shown as a gasoline-powered motor, and in a one preferred embodiment is a six (6) horsepower Briggs and Stratton Vanguard engine. An idler pulley 120 is also carried within bracket 80, and will be discussed in further detail below. Shroud 32 attaches to a bracket 122 via bolt and nut combinations, generally 124.

FIG. 3 is a view of the bottom of machine 10 and illustrates the construction of frame F and the attachment of support bar 38 to frame F. Support bar 38 carries guard 32, which extends in front of trenching blade 26. Trenching blade 26 includes outwardly extending digging fingers 128, and trenching blade 26 is bolted to an axle 130 (FIG. 5) connected to drive pulleys 116, 118. Note that rear wheel 96 is spaced outboard of trenching blade 26 in order to maintain the stability of machine 10 during use.

Figure 4:
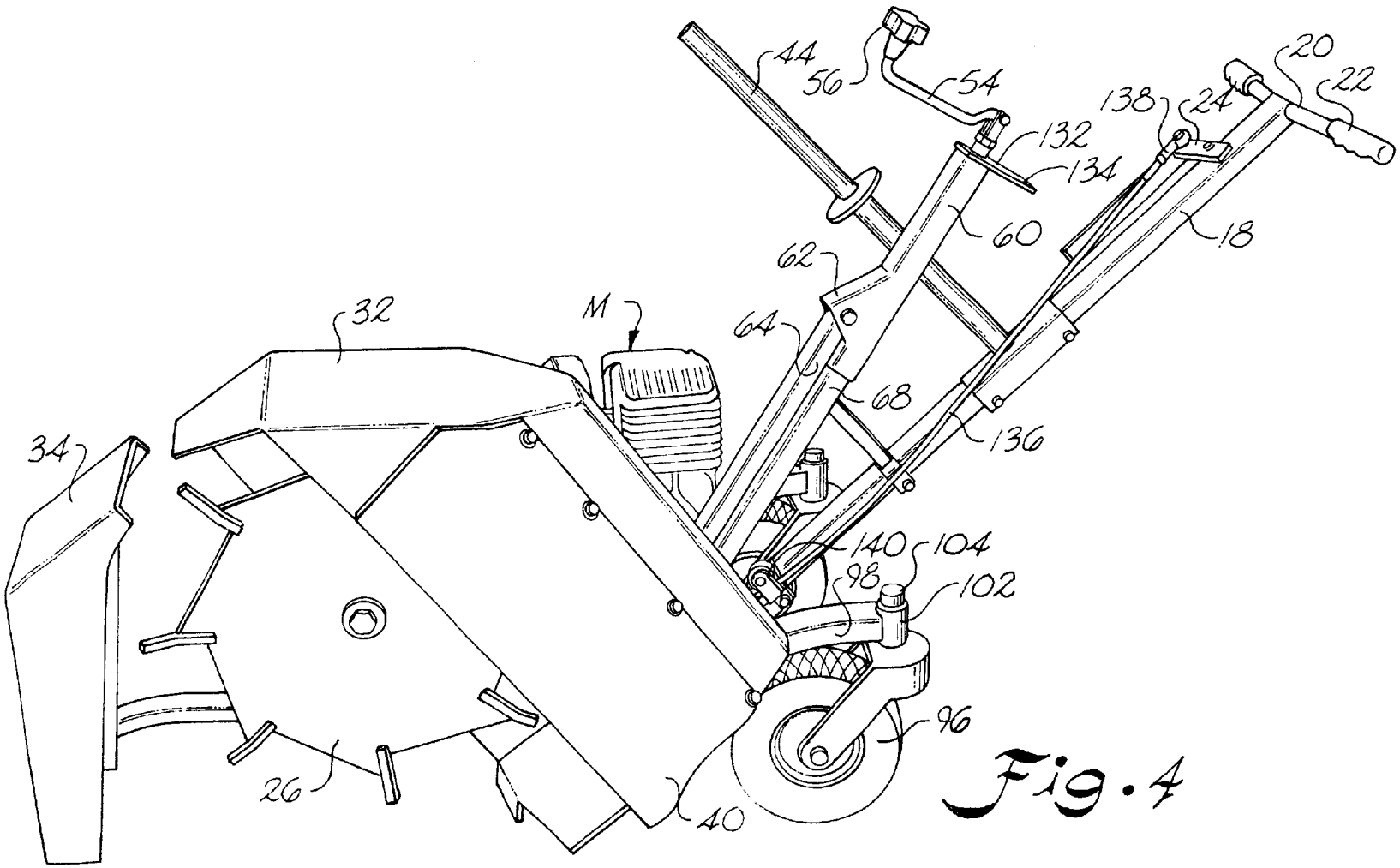
FIG. 4 is a left side perspective view of the trenching and edging machine constructed in accordance with the present invention.

FIG. 4 illustrates crank arm 54 pivoted outwardly in a position for turning by knob 56. A bracket 132 is provided with a retaining hole 134 for holding crank arm 54 and preventing it from rotating during use. This maintains the digging height of the blade once adjusted with crank arm 54.

FIG. 4 also illustrates cable 136 extending downwardly from drive lever 24. Cable 136 is connected to drive lever 24 via a pivotal connector 138, and cable 136 passes beneath a guide roller 140, which is attached to handle support arm 18.

Figure 5:
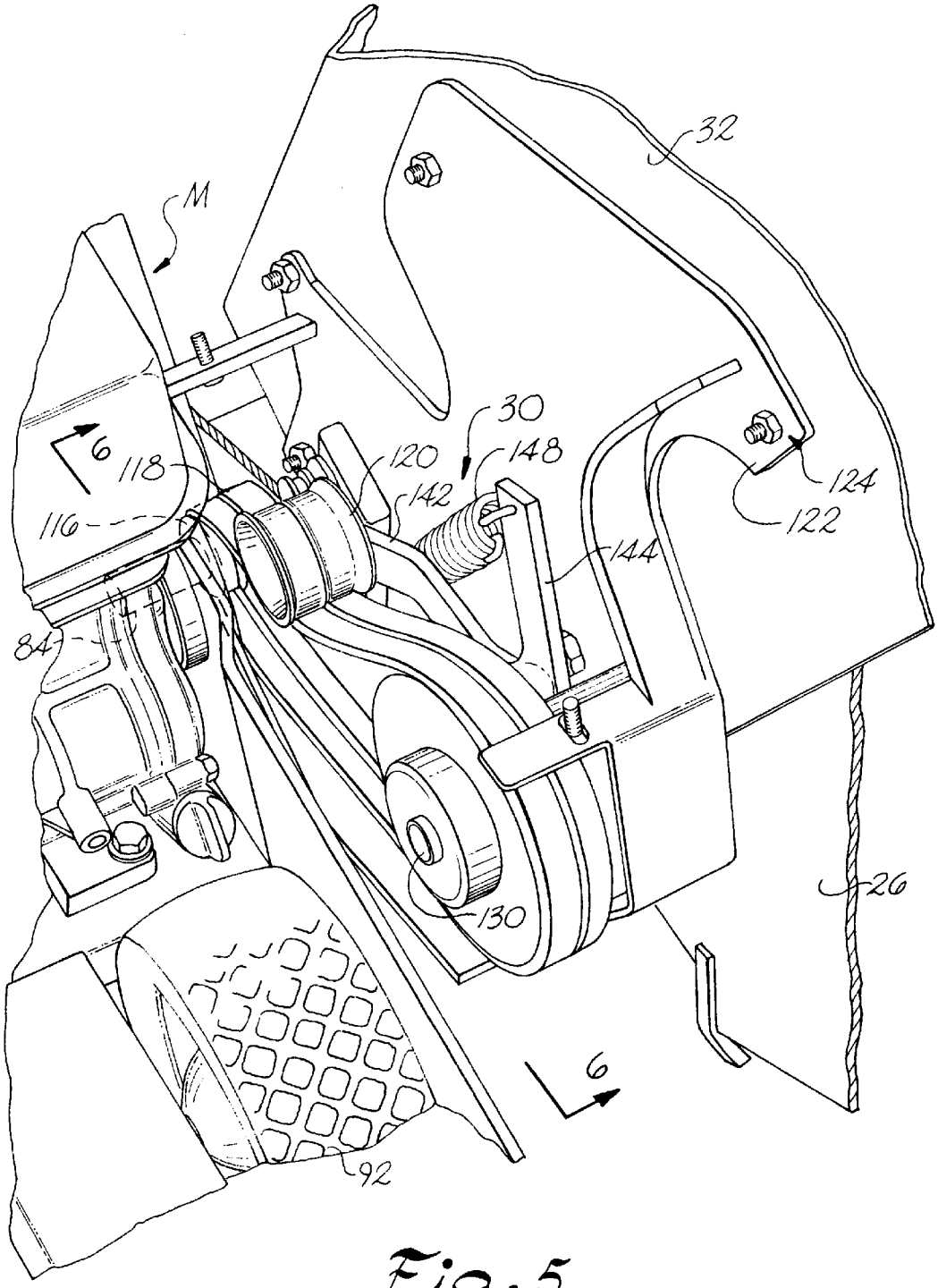
FIG. 5 is a partial perspective view of the blade drive configuration of the trenching and edging machine illustrated in FIGS. 1 through 4.
Figure 6:
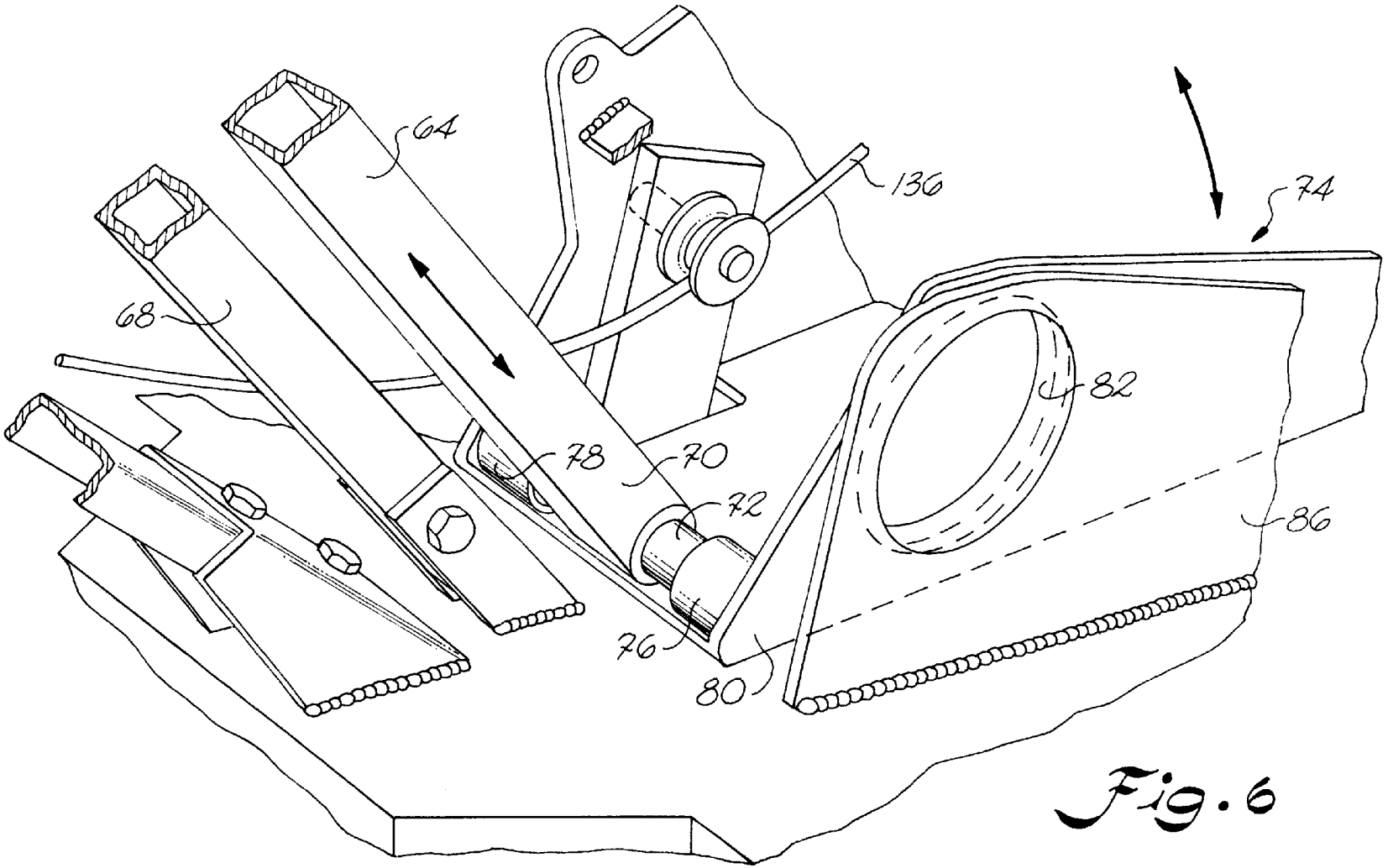
FIG. 6 is a partial perspective view taken along lines 6—6 of FIG. 5.

Cable 136 extends from guide roller 140, as shown in FIG. 5, and terminates in a driving engagement member 142, which includes and upstanding arm 144 and idler pulley 120. A return spring 148 is also attached to arm 144. Return spring 148 is attached at its other end to cable 136. When drive lever 24 is pulled towards handle 20, cable 136 is tightened. This pulling of the drive lever is performed against the tension force of return spring 148, and the pulling of cable 136 causes member 142 to pivot, which in turn forces idler pulley downwardly against drive belts 112, 114, thereby causing them to snuggly engage pulleys 108, 110, 116, 118. This in turn causes the rotation of motor output shaft 84 to drive pulleys 116, 118, to therefore drive the digging blade. Drive lever 24 acts as a "dead man" control, such that should worker W release drive lever 24, idler pulley 120 retracts, thereby causing slack to be formed in drive belts 112, 114, and the driving of digging blade B ceases. FIG. 5 illustrates idler pulley 146 in driving engagement with the drive belts.

Figure 9C:
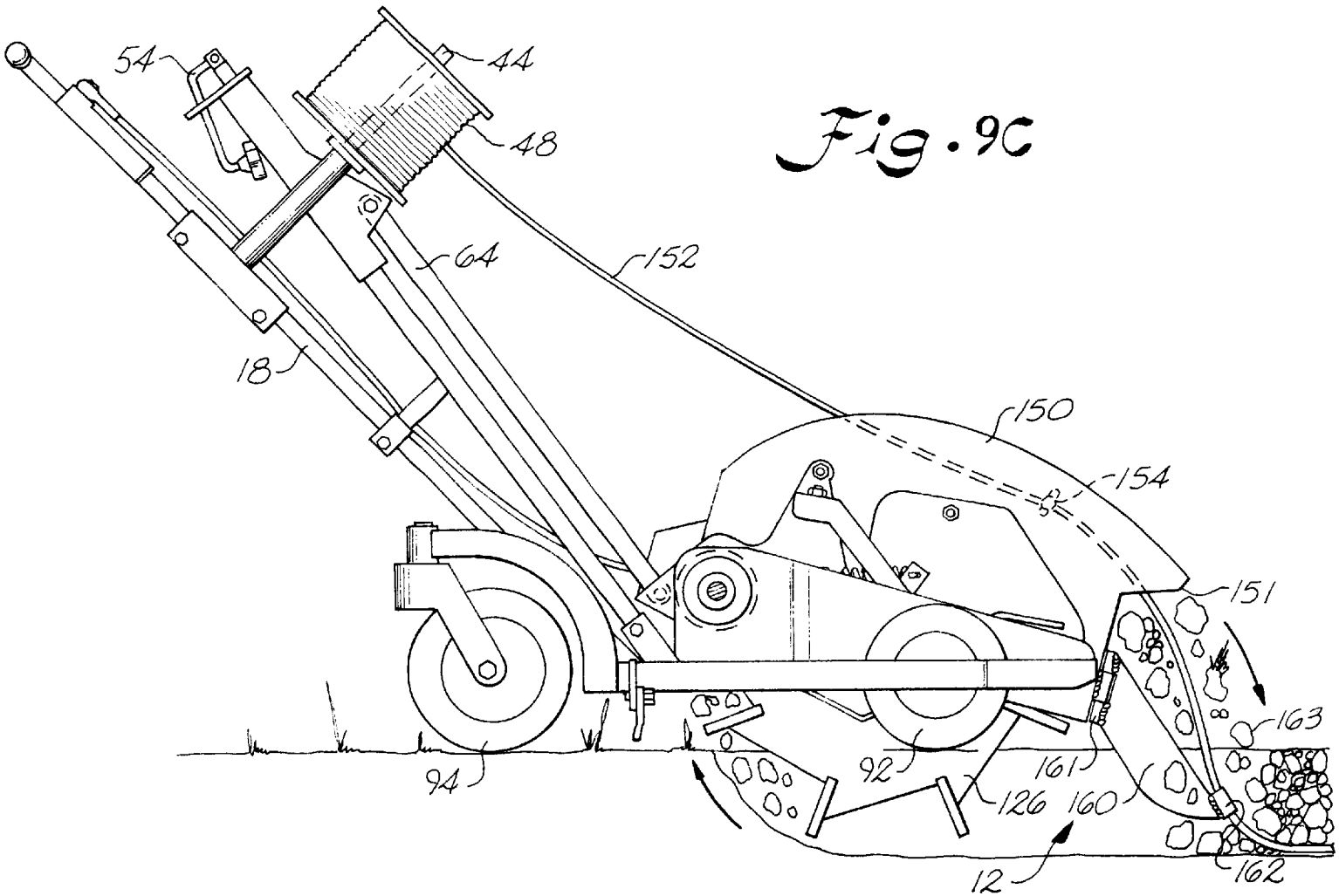
FIG. 9C is a partial side elevational view illustrating the trenching and edging machine in the present invention simultaneously digging a trench, laying cable, wire, tubing, etc. and backfilling the trench.
Figure 10:
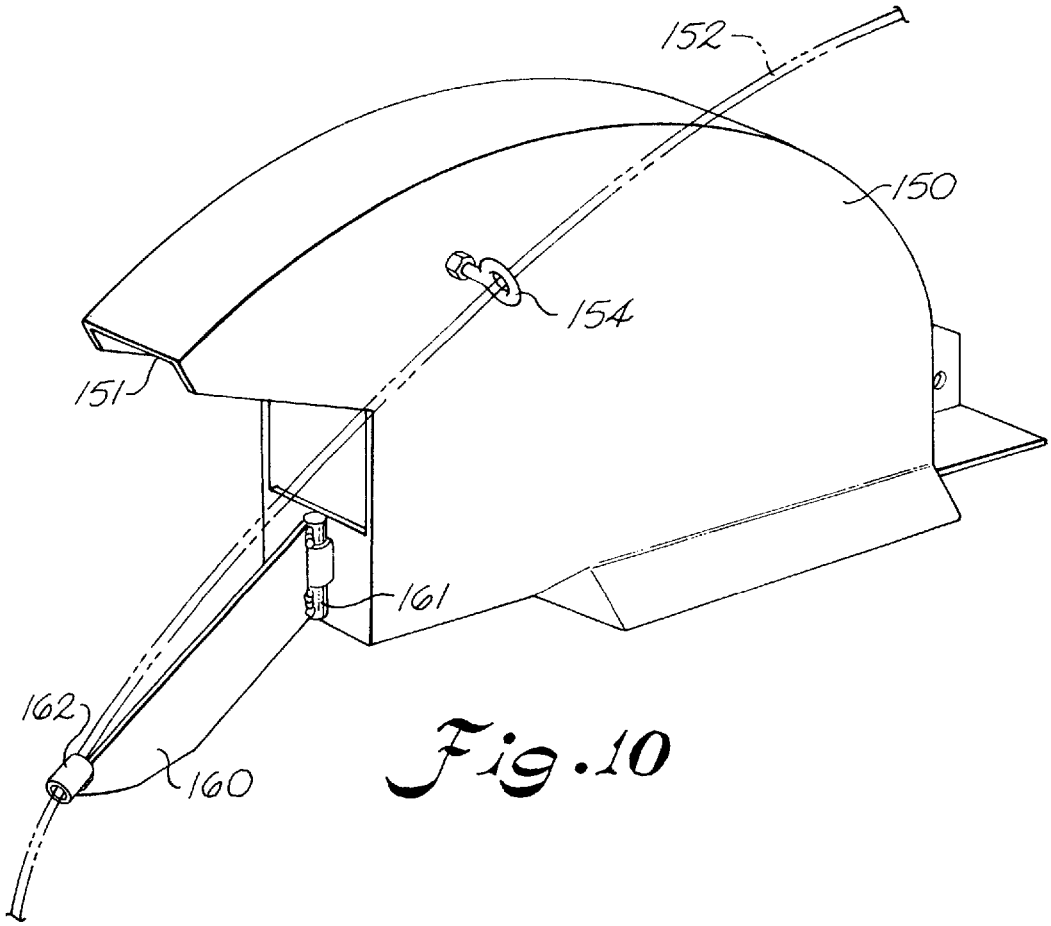
FIG. 10 is a perspective view illustrating a hood for use in connection with the trenching machine for guiding and placing cable, wire, tubing, etc. within a trench.

FIGS. 9C and 10 illustrate use of machine 10 as a trenching, cable, tubing, wire, etc. laying, and backfill machine. This is one of the three major functions of the present invention. Use of machine 10 as a trenching machine has been discussed above. Trenches formed by such machine would be useful in laying sections of rigid pipe, for example, which are not flexible or of small enough diameter to be carried on a spool. However, where it is desired to lay cable, tubing, wire, etc. which is capable of being carried on a spool, then machine 10 can be used to dig a trench, lay such item and bury it all in a single pass. In this configuration machine 10 includes a hood 150 which attaches to frame F and which replaces shroud 32. Hood 150 has a delivery chute 151 for returning soil which is being dug by trenching blade 26 back into the same trench. In the interim, however, an elongated member 152 such as pipe, cable, tubing, wire, drip line, pays out from spool 48 and is placed within the trench 12. The elongated member 152 passes from spool 48 to an eyelet, or guide 154 carried on hood 150. The elongated member then extends downwardly towards the trench, but first passes through a pivotal foot 160 which is pivotally connected to a front portion of hood 150 in a hinge-like configuration 161. At the lowermost portion of foot 160, a second guide 162 is carried through which the elongated member 152 passes. Foot 160 is allowed to pivot from side to side to accommodate for irregularities which may be found in the trench as the trench is dug. As the foot directs the elongated member to the lower portion of the trench, backfill soil 163 is simultaneously being delivered from the delivery chute 151 of hood 150 to backfill the trench, and, accordingly bury the elongated member 152.

Figure 11:
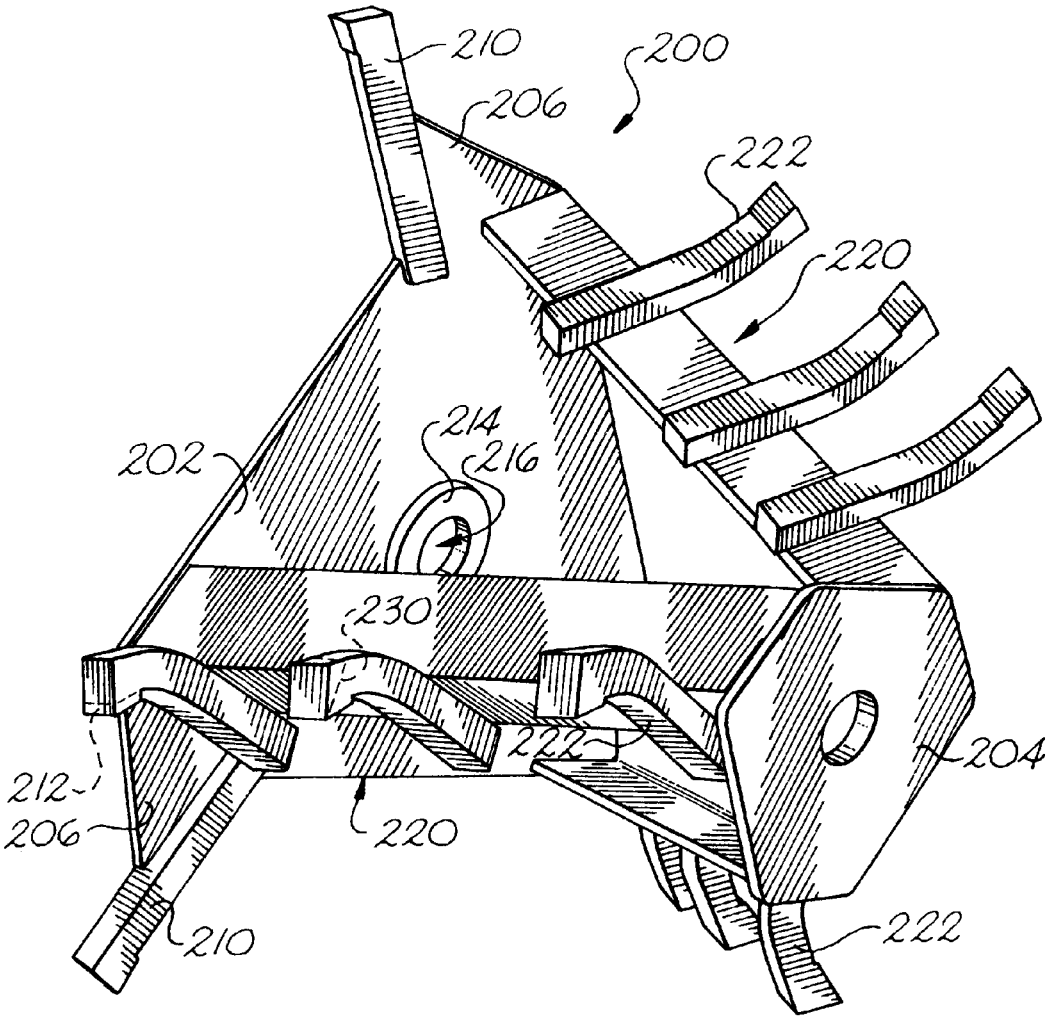
FIGS. 11 through 13 are perspective views of an edging blade constructed in accordance with the present invention.
Figure 12:
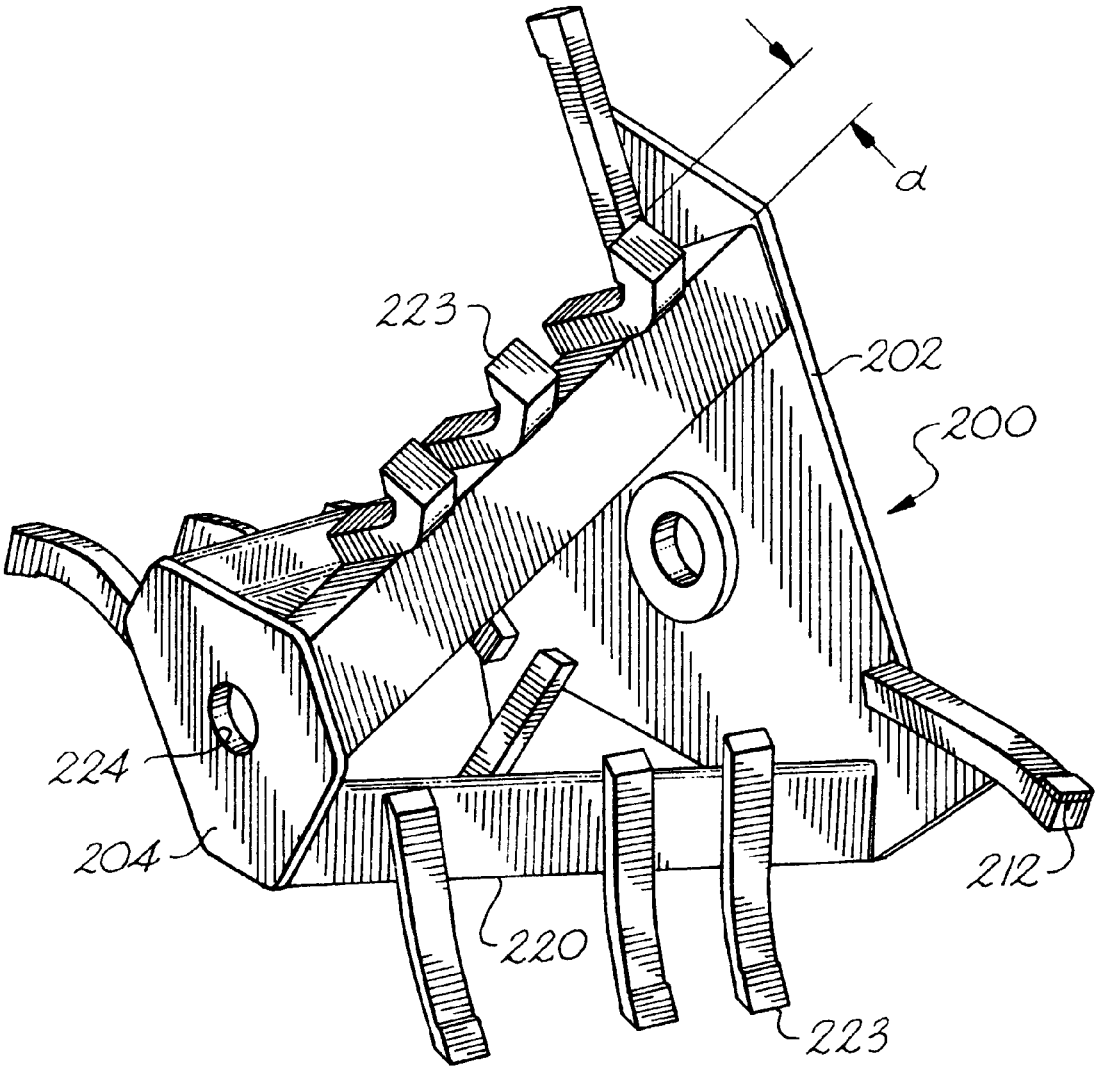
Figure 13:
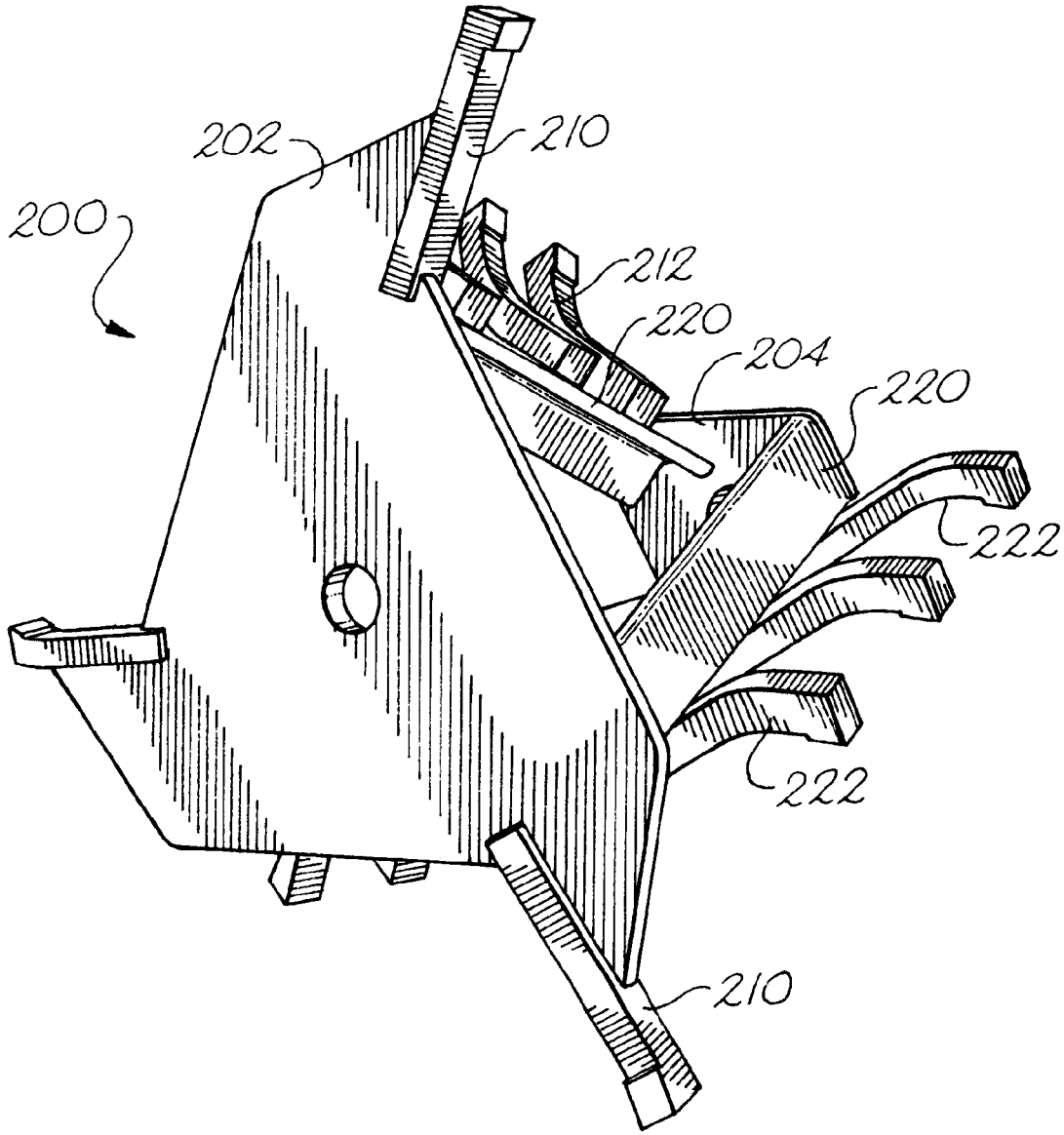

FIGS. 11 through 13 illustrate a bed edging blade 200 of the present invention. Machine 10 can be provided with the trenching blade 26, as discussed above, or other suitable digging blades (not shown), or the landscaping bed edging blade 200, thereby rendering machine 10 as capable of performing three functions, namely, (a) trenching; (b) trenching, laying, and backfilling; and (c) edging of beds.

Edging blade 200 is in overall shape generally similar to a pyramid or cone and includes a base plate 202, and an end plate 204. Base plate 202 is of a generally triangular shape, but includes three brace, or gusset, portions 206 which extend outwardly behind each of three base digging fingers 210. Digging fingers 210 are preferably constructed of spring steel and preferably include at the ends thereof carbide cutting blades 212. Digging fingers 210 are preferably welded to base plate 202, which is in one preferred embodiment, made for mild steel. Base plate 202 includes a boss 214 which defines an axle opening 216 for receiving the drive axle 84 of drive pulleys 116, 118. Extending upwardly from base plate 202 and terminating in end plate. 204 are three support members, or ribs, generally 220, each of which are substantially equidistantly spaced apart from one another and acutely angled with respect to base plate 202. These support members 220 are preferably constructed of steel and have an angled cross-section. Each support rib carries three digging fingers 222.

Turning to FIG. 12, these digging fingers 222 are inwardly curved along their respective lengths. Each digging finger preferably includes a carbide tip or blade 212 at the end thereof. The leading edge 223 of each carbide tip is preferably substantially parallel to the support rib on which it is carried, as shown by arrows a. In other words, the angle of the leading edge of a digging finger with respect to base plate 202 is acute and is substantially the same acute angle as formed between the support rib 220 on which such digging finger 222 is carried and base plate 202.

End plate 204 includes an opening 224 for allowing a socket wrench extension (not shown) to pass therethrough when edging blade 200 is attached to axle shaft 84 through use of a nut 226.

The above-described construction of edging blade 200 provides certain advantages. First, as the edging blade is used, the outboard corner 230 (FIG. 11) of each digging finger 222 tends to hit the soil first during use and accordingly becomes worn down, such as shown in phantom in FIG. 11. This ultimately causes a sharpening effect of the digging finger, and as wear of a tooth advances, continues to maintain the extreme ends of the digging fingers sharp. In essence, the digging fingers become generally self-sharpening.

Another advantage of the above construction is that because the digging fingers 222 are angled outwardly with respect to base plate 202, i.e., the leading edge 223 of a digging finger 222 does not approach the soil precisely parallel to the soil surface. This causes the leading edge 223 to thus pierce, or shear, the soil incrementally as the lowermost portion of the finger first hits the soil and then the remainder of the leading edge 223 contacts the soil thereafter. This cutting action has been analogized to how scissors operate in that the entire cut to be made in a piece of paper, for example, by a pair of scissors, does not occur instantaneously, but instead the cut advances as the scissors are closed. This shearing action of digging fingers 222 is believed to provide a better digging action, as the digging fingers are less apt to "beat" or reverberate against the soil surface, since they do not approach the soil surface in a direct parallel relationship. The shearing action of the angled digging fingers 222 is also believed to improve use of the edging blade on hard soil, since a direct parallel approach of the digging fingers would likely cause more vibration and perhaps a "bouncing" of the digging fingers on such hard soil surface.

A further advantage of the leading edges of the digging fingers being angled outwardly with respect to the base plate 202, is that such angling of the digging fingers causes an augering effect of the soil as the blade is used. This augering effect tends to propel the soil away from the base plate 202, thereby building a desirable mound angled outwardly and tapered into the edge of the bed being worked. This also provides for a cleaner vertical wall, which is dug by base plate 202 and the base plate digging fingers 210. The angled support ribs 222 tend to further provide an auguring effect, also forcing the soil upwardly on the bed mound.

Figure 14:
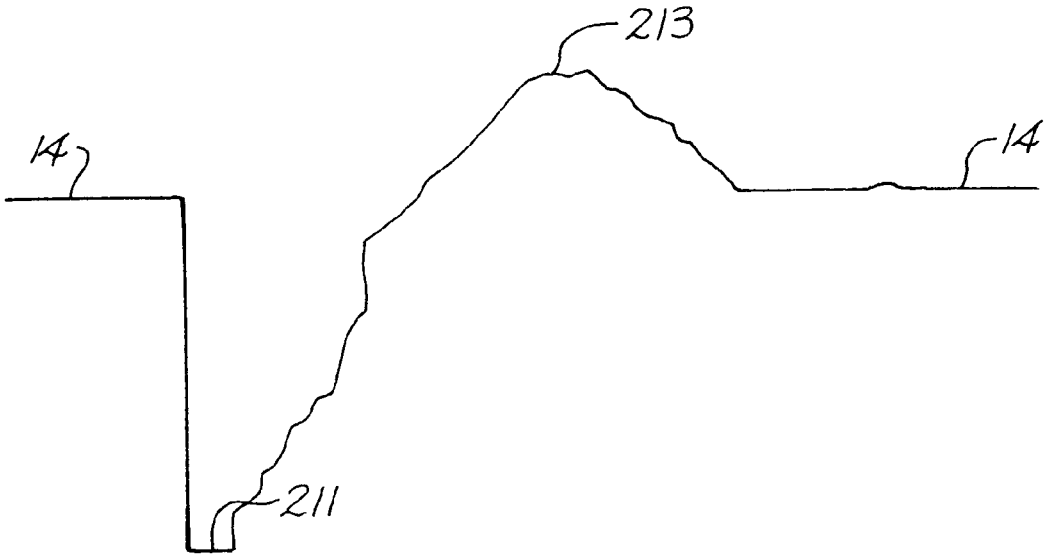
FIG. 14 is a simplified view of a bed edge having a groove in the soil below the depth of the bed edge formed using the edging blade of the present invention.

Another significant feature of edging blade 200 is the fact that the base plate digging fingers 210 dig a groove 211 as shown in FIG. 14 extending below the base of the bed edge 213 being constructed. This groove allows for placement and receipt of drip line, which may be used to carry herbicide, fertilizer, pesticide, etc. around the perimeter of the bed. The groove could also be used to bury pet containment system wire, also known as invisible fencing.

By providing the three support ribs on edging blade 200, the digging action of the blade 200 is staggered, as compared to prior art digging blades having two diametrically-opposed digging blade structures. This allows for a smoother operation and also staggers the cutting action of the blade, allowing for more continuous cutting action. This is expected to allow more digging capability for the same amount of horsepower motor as has been used in the past.

Further, with regards to the base plate digging fingers 210, such fingers are effectively reinforced and supported along their length by the gussets 206 of base plate 202. These gussets support the back side of each base plate digging finger, to thereby strengthen and prolong the life of such digging fingers.

The earth-working machine 10 of the present invention thus provides a versatile system for digging trenches, burying tubing, conduit, wire, etc., and also for forming edges of beds in the soil. As the machine is relatively small, and portable, it can be used in situations where bigger machines would not be appropriate, and also, because of its relatively small size, is less destructive on lawns, turf, etc., than would be certain larger machines.

Machine 10 is particularly maneuverable for equipment of its type. Another noteworthy feature is the position of the front wheel 92 with respect to the digging blade B, be it the trencher blade 26 or the edging blade 200. As can be best seen from FIG. 9A, as the digging blade is pivoted in an arc from its lowermost position to its uppermost position, the center of rotation thereof remains close to the center of rotation of the front wheel, since the radius of the arc extends only slightly beyond front wheel 92. In other words, whether the axis of rotation of the digging blade is above or below such axis of rotation, the digging blade can be in general vertical alignment with the axis of the front wheel, broadly speaking, and such positioning is sufficient to allow improved maneuverability of machine 10 during operation. Since the axis of rotation of the digging blade is close to that of the front wheel, through use of the steerable caster wheels, and because the front wheel is laterally spaced as closely as practical to the digging blade, relatively tight turns can be made with the machine 10 as it is pulled rearwardly during use.

Another feature of machine 10 is the safety aspect afforded by shroud 32 and guard 34. Shroud 32 and guard 34 are configured to shield the digging blade not only when the digging blade is in its lowered, digging position, but also when it is in its raised, transport position. Furthermore, both shroud 32 and guard 34 can be used with either trenching blade 26 or edging blade 200.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A soil bed edge forming machine for use in creating defined mounded soil borders for defining landscaping beds, the machine comprising:

a frame;

a motor and wheels connected to said frame;

a digging blade; said motor being drivingly connected to said digging blade; and an elongated digging depth adjustment member connected to said digging blade; said adjustment member defining a central axis and being threaded and rotatable about said central axis for allowing selective digging depth adjustment of said digging blade into the soil.

2. A soil bed edge forming machine as defined in claim 1, wherein at least two of said wheels are caster wheels.

3. A soil bed edge forming machine as defined in claim 1, wherein said frame includes a front portion and a rear portion and wherein said wheels include a single wheel mounted on said front portion and two caster wheels mounted on said rear portion of said frame.

4. A soil bed edge forming machine as defined in claim 1, further including a bed edging blade, comprising:

a base plate and an end plate;

at least two arms connected to said base plate and said end plate, said arms being acutely angled with respect to said base plate; and outwardly extending digging fingers connected to said arms.

5. A soil bed edge forming machine as defined in claim 1 wherein the axis of rotation of said digging blade is in generally vertical alignment with at least one of said wheels.

6. A bed edging blade for attachment to a shaft of a bed edging machine for use in creating mounded soil borders for defining landscaping beds, comprising:

a base plate;

an end plate separate from said base plate;

at least two arms connected to said base plate and to said end plate, said arms being acutely angled with respect to said base plate, and said arms holding said end plate outwardly from said base plate; and outwardly extending digging fingers connected to said arms.

7. A bed edging blade as defined in claim 6, wherein at least one of said digging fingers includes a carbide digging blade.

8. A bed edging blade as defined in claim 6, further comprising said digging fingers being inwardly curved along their length.

9. A bed edging blade as defined in claim 6, wherein said at least one of said two arms includes a digging finger having a forward cutting edge acutely angled with respect to said base plate.

10. A bed edging blade as defined in claim 6, wherein said base plate includes at least one outwardly extending digging finger for digging a groove below the depth of the bed edge.

11. A bed edging blade as defined in claim 6, wherein said base plate includes at least one outwardly extending digging finger and a brace portion connected to and extending adjacent the major portion of the length of said digging finger.

12. A bed edging blade as defined in claim 6, wherein said blade is of a generally pyramid shape.

13. A method for creating defined mounded soil borders for defining landscaping beds and for installing an elongated member in the ground, the method comprising:

providing a bed edging machine having a combination bed-edging and groove-forming digging blade;

moving the machine rearwardly to form a trench of a first depth and a mounded bed edge in the soil adjacent only one side of said trench with said bed-edging and groove-forming digging blade;

simultaneously forming a defined groove in the soil at a second depth below said trench with said bed-edging and groove forming digging blade, said second depth being deeper than said first depth; and inserting an elongated member into said groove at said second depth.

14. A trenching machine for placement of cable, tubing, wire, and pipe in the soil, comprising:

a frame;

a motor and wheels connected to said frame;

a trenching blade; said motor being drivingly connected to said trenching blade, and said trenching blade being operable to dig a trench in soil when the machine is moved rearwardly;

a holder connected to said frame for holding the elongated material;

a guide connected to the frame for guiding the elongated material into the ground;

a delivery chute associated with said trenching blade for delivering soil to a trench dug by said trenching blade to backfill the trench and bury the elongated material; and a first wheel mounted on said front portion of said frame and two caster wheels mounted on said rear portion of said frame, wherein the axis of rotation of said trenching blade is in generally vertical and parallel alignment with the axis of rotation of said first wheel, for allowing the trenching machine to be readily steered as it is moved rearwardly.

15. A machine as defined in claim 14, further comprising a foot member connected to said guide.

16. A machine as defined in claim 14, further comprising a foot member connected to said guide, and wherein said foot member is pivotally attached to said delivery chute.

17. A machine as defined in claim 14, further comprising a spool holder for supporting a spool of the elongated material.

18. A machine as defined in claim 14, further including a bed edging blade attachable to said motor, comprising:

a base plate and an end plate;

at least two arms connected to said base plate and said end plate, said arms being acutely angled with respect to said base plate; and outwardly extending digging fingers connected to said arms.

19. A soil bed edge forming machine for use in creating defined mounded soil borders for defining landscaping beds, the machine comprising:

a frame defining a front portion and a rear portion;

a motor connected to said frame;

a soil bed edging blade; said motor being drivingly connected to said soil bed edging blade, and said soil bed edging blade being operable to form a trench and a mounded soil bed edge on only one side of said trench when the soil edge forming machine is moved rearwardly; and a first wheel mounted on said front portion of said frame and two caster wheels mounted on said rear portion of said frame, wherein the axis of rotation of said soil bed edging blade is in generally vertical and parallel alignment with the axis of rotation of said first wheel, for allowing the soil edge forming machine to be readily steered as it is moved rearwardly.

20. A soil bed edge forming machine for use in creating defined mounded soil borders for defining landscaping beds, the machine comprising:

a frame defining a front portion and a rear portion;

a motor connected to said frame;

a soil bed edging blade; said motor being drivingly connected to said soil bed edging blade, and said soil bed edging blade being operable to form a trench and a mounded soil bed edge on only one side of said trench when the soil edge forming machine is moved rearwardly;

a first wheel mounted on said front portion of said frame and two caster wheels mounted on said rear portion of said frame, wherein the axis of rotation of said trenching blade is in generally vertical alignment with said first wheel for allowing the soil edge forming machine to readily be steered as it is moved rearwardly; and an elongated digging depth adjustment member connected to said soil bed edging blade; said adjustment member defining a central axis and being threaded and rotatable about said central axis for allowing selective digging depth adjustment of said digging blade into the soil.

* * * * *